United States Patent [19]

Tucci

[11] 4,032,211

[45] June 28, 1977

[54] MULTI-CONDUCTOR HALF-TAP CONNECTION

[75] Inventor: John James Tucci, Winston-Salem, N.C.

[73] Assignee: AMP Incorporated, Harrisburg, Pa.

[22] Filed: Nov. 1, 1976

[21] Appl. No.: 737,827

Related U.S. Application Data

[62] Division of Ser. No. 649,010, Jan. 14, 1976, Pat. No. 4,007,534.

[52] U.S. Cl. ..... 339/99 R
[51] Int. Cl.² ..... H01R 13/38
[58] Field of Search ..... 339/97–99

[56] References Cited

UNITED STATES PATENTS

| | | | |
|---|---|---|---|
| 3,824,530 | 7/1974 | Roberts et al. | 339/99 R |
| 3,877,771 | 4/1975 | Jensen et al. | 339/99 R |
| 3,963,300 | 6/1976 | Patton et al. | 339/99 R |

*Primary Examiner*—Joseph H. McGlynn
*Attorney, Agent, or Firm*—Robert W. Pitts; Frederick W. Raring; William J. Keating

[57] ABSTRACT

A tap connection for a multi-conductor cable is disclosed. This tap connection uses two standard separate multi-contact connectors. Cable wires connect corresponding terminals in each of the two connectors. A method and apparatus for assembling this tap connector is also disclosed. Pairs of cable wires are simultaneously inserted into corresponding slotted terminals in both connectors.

10 Claims, 6 Drawing Figures

MULTI-CONDUCTOR HALF-TAP CONNECTION

This is a division of application Ser. No. 649,010 filed Jan. 14, 1976, now U.S. Pat. No. 4,007,534.

BACKGROUND OF THE INVENTION

1. Field of Invention

This invention relates generally to the fabrication of multi-conductor tap connections using individual multi-contact connectors. A tap connector together with an appropriate method and apparatus for assembly is disclosed. The particular apparatus shown is an improved version of earlier applicators used to trim and insert wires into slotted terminals. This new apparatus can be used to insert each separate wire into two aligned terminals in separate connectors.

2. Description of the Prior Art

A standard multi-contact connector for use in terminating multi-conductor cable is disclosed and claimed in U.S. Pat. No. 3,760,355. The present tap connector embodiment utilizes two mating connectors of the type shown in the above mentioned patent. Similar multi-contact ribbon connectors could also be used to form the tap connection which is the subject of this invention.

Apparatus for attaching cable wires to multi-contact connectors are disclosed in U.S. Pat. No. 3,766,622 and application Ser. No. 556,983 filed Mar. 10, 1975. The apparatus claimed in the present application is an improved tool which utilizes many features of these earlier tools.

Other tap connections using the connector disclosed in U.S. Pat. No. 3,760,335 are disclosed and claimed in U.S. Pat. Nos. 3,866,295 and 3,824,530. A tap connector is also disclosed in U.S. Pat. No. 3,876,276. One problem faced by all of the prior art devices is the difficulty of accomodating a plurality of wires in a relatively compact tap connector consisting of two separate multi-contact connectors. This problem is especially apparent when connectors having two parallel terminal rows are used. It should be noted that only a limited number of taps can be fabricated using the technique of U.S. Pat. No. 3,866,295. In U.S. Pat. No. 3,876,276, separate soldered connections between corresponding terminals are required. FIG. 1 of U.S. Pat. No. 3,824,530 reveals one component which could be used to form an equally equivalent tap connection. It is difficult to visualize how a compact tap connector could be fabricated in this manner since some provision must be made for the plurality of wires which get in the way. The tap connector embodied in this invention uses the cable wires to interconnect the two separate connectors comprising this tap connector.

A relatively rapid fabrication method is disclosed in this invention. A simple repetitive one-step operation is used to attach the individual cable wires to both connectors. Both the fabrication method and the tap connector itself utilize a wire lacing pattern which is different from that used in earlier applications of the connector disclosed in U.S. Pat. No. 3,760,335 and similar connectors.

SUMMALRY OF THE INVENTION

A tap connection using standard multi-contact connectors to terminate multi-conductors cable is disclosed and claimed. Individual cable wires interconnect the two multi-conductor connectors which comprise the tap connector. The rearward wire receiving sides of the individual connectors are closely adjacent, and corresponding terminals are in alignment. Each wire initially extends inwardly from one end of one connector. Each wire then turns, forming a right angle and extends parallel to the axis of corresponding terminals.

A method and apparatus for simultaneously inserting individual wires into corresponding terminals in two separate connectors is also disclosed and claimed. The apparatus is a modification of existing applicators for trimming and inserting wires into multi-contact connectors. The method comprises a repetitive one step operation in which the wires are sequentially laced into position for insertion.

Among the objects of this invention is the relatively simple fabrication of a multi-conductor tap connection utilizing standard connectors. This tap connection needs to be relatively compact while retaining the ability to accomodate a large number of wires and terminals. This need is especially apparent when connectors having two parallel rows of up to 32 terminals each are used. These and other objects of this invention are achieved by an invention disclosed by the preferred embodiment shown in the accompanying figures.

DETAILED DESCRIPTION OF THE INVENTION

Figure 1:
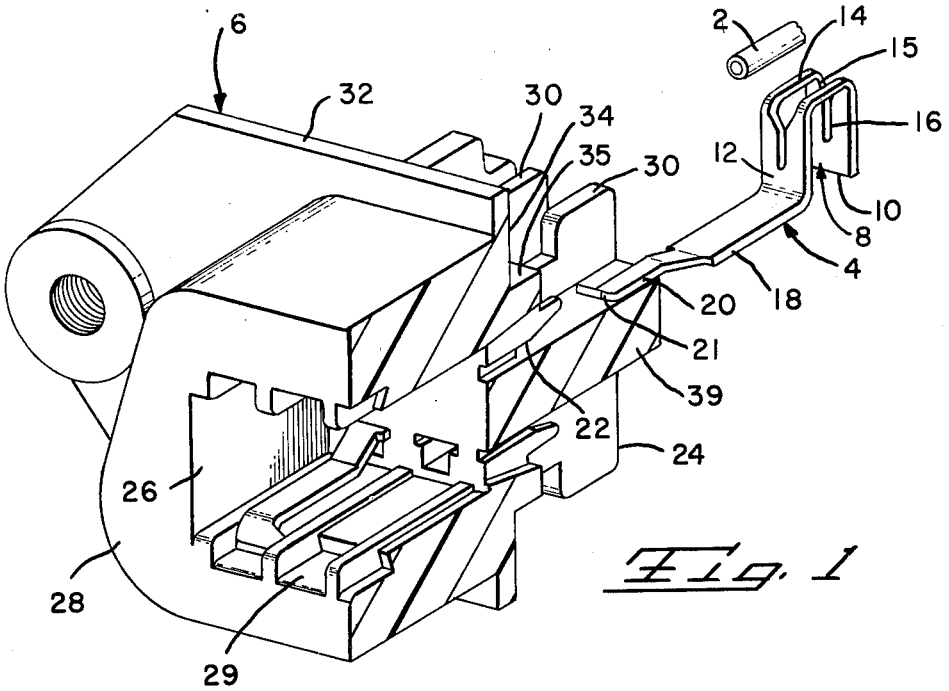
FIG. 1 is a half-section showing a single standard multi-contact connector together with the terminal used therein.

The herein disclosed embodiment of the invention is intended for use in inserting insulated wires 2 into the wire receiving portion 8 of each one of a plurality of electrical terminals 4 contained in an electrical connector 6 to form a tap connection for a multi-conductor cable. Connectors and terminals as disclosed in FIG. 1 are fully described in U.S. Pat. No. 3,760,335, however some structural features of the connector and the terminal must be described here for an understanding of the present invention. The wire receiving portion 8 of each terminal is generally U-shaped having spaced apart parallel plate like sections 10, 12 which are connected by a bight section 14. A slot extends through the bight 15 and into the plate-like sections at 16 so that when the wire is forced downwardly and to the slot, the edges of the slot will penetrate the insulation of the wire and establish electrical contact with the conducting core thereof.

The terminal 4 further comprises a flat shank 18 extending from plate section 12 and an offset contact portion 20 which has a laterally extending ear 21 on its end. A plurality of cavities 22 extend through the connector housing from the rearward side 24 thereof and open into a trough 26 in the forward or mating side 24 thereof and open into a trough 26 in the forward or mating side 28 of the housing. These cavities and recesses 29 on the sides of the trough 26 are contoured to receive the terminals 4. The connectors shown are adapted to be mated with a complementary connector as disclosed in U.S. Pat. No. 3,760,335. Barriers 30 are provided on the connector housing adjacent to the rearward side 24 between adjacent cavities 22. It should also be noted that a flange 32 extends outwardly from the housing between the rearward and mating faces and a rearwardly facing surface 34 and ledge 35 are defined by the rearwardly facing side of this flange.

Conventionally, wires are attached to terminals in connector 6 by inserting the wire laterally of its axis into slot 16. The wire would be trimmed adjacent to inner plate section 12. Each wire would extend through the appropriate terminal. At some point adjacent to outer plate like section 10, each wire would be bent through a right angle. The wires then extend along the rearward side of the connector to a common multi-conductor cable located at one end.

Figure 2:
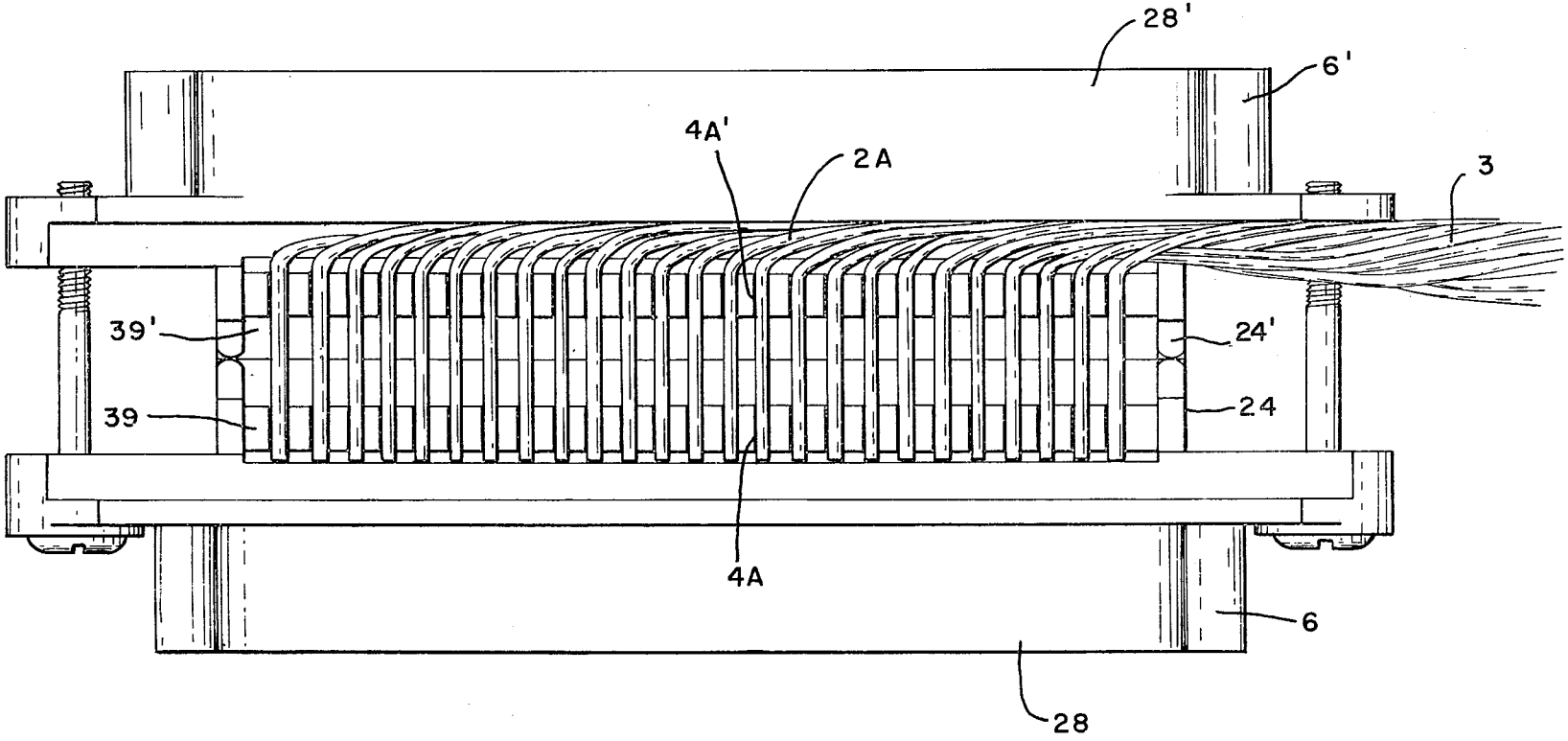
FIG. 2 illustrates the tap connector which comprises two back-to-back connectors with cable wires extending from one end.

The tap connection which is the subject of this invention incorporates a somewhat different pattern for attaching the wires. FIG. 2 shows two multi-contact connectors 6 and 6′ with their rearward sides 24 and 24′ adjacent to and facing each other. Ribs 39 and 39′ are in alignment and can be touching. Corresponding terminals in each of the two connectors are therefore in axial alignment. The connectors shown in FIG. 2 are mating connectors. Rearward side 28 on the first connector can be mated with the rearward side 28′ on the second connector. Note the trapezoidal shape of mating side 28 on connector 6 partially indicated in FIG. 1. This trapezoidal shape makes this connector assymetric so that each of the two rows in the connector is distinct. Mating side 28′ of connector 6′ is likewise trapezoidal. Mating side 28′ differs from mating side 28 and is designed to receive mating side 28. Connector 6′ has terminals extending from its rearward side to its mating side. The contact portion 20′ of terminals in connector 6′ are oriented so that contact may be established with corresponding terminals upon insertion of mating side 28 into mating side 28′. Connector 6′ has been positioned in FIG. 2 so that each terminal and row therein is aligned with its corresponding terminal and row in connector 6. Upon reflection, it should be apparent that the trapezoid in mating sides 28 and 28′ must be opposed.

With connectors 6 and 6′ positioned as shown in FIG. 2 a T-tap connection for a multi-conductor cable can be formed. In this T-tap connection, two connectors are attached at the end of cable 3 with two mating sides each available for interconnection with separate multi-conductor cables. Wires 2 are attached to each connector with the wires also forming the interconnection between connectors. To illustrate the manner in which these wires are attached, the path of one wire 2A, which is attached to corresponding terminals 4A and 4A′ each intermediate the ends of the rows of wire receiving portions in the connectors, will be described. Cable 3 has been positioned adjacent to one end of the connectors and is generally parallel to the rows of wire receiving portions. The cable would then be transverse to individual terminals 4. Wire 2A extends from cable 3 past intermediate wires which have already been attached to both connectors. The wire extends along a path between the wire receiving row and mating side 28′ of first connector 6′. Note that in the connector shown, a trough formed by surfaces 34, 35 and the inner edges of barriers 30 is formed between the terminal rows and the mating side. (See FIG. 1). Wire 2A extends generally along this trough until it reaches terminal 4A. At this point, wire 2A is bent through a right angle and extends parallel to terminals 4A and 4A′. Wire 2A is then in alignment with wire receiving portions or slots 16 in each of the terminals. Note that in the embodiment shown in FIG. 2, the end of each wire is located adjacent to the wire receiving portions of terminals in the second connector 6′.

Figure 3:
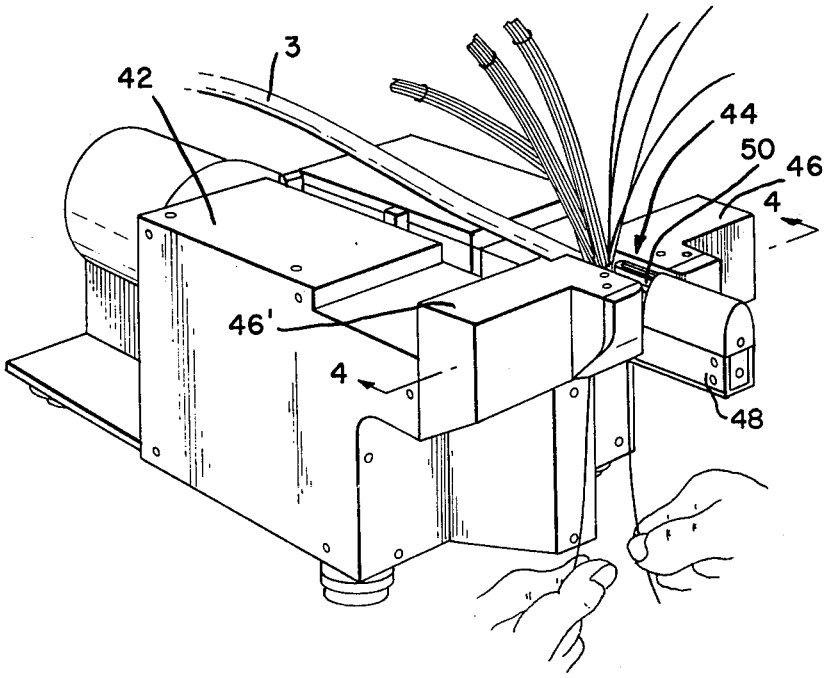
FIG. 3 is a perspective view of the assembly apparatus illustrating the method of lacing a pair of wires on opposite sides of each back-to-back connector pair.

In order to efficiently fabricate a tap connection such as that shown in FIG. 2, a modified semi-automatic tool is required. This modified tool is similar to the tool disclosed in U.S. Pat. No. 3,766,622 as modified in U.S. pat. application Ser. No. 556,983 filed Mar. 10, 1975. The above patents are hereby incorporated by reference. A relatively general discussion of the tooling disclosed therein is necessary for a complete understanding of the instant invention. FIG. 3 shows the modified semi-automatic tool used to fabricate the tap connector assembly shown in FIG. 2. Tool 42 has an insertion zone 44. A pair of wires 2 and 2′ extending from cable 3 are shown extending through insertion zone 44. Oppositely facing insertion housing 46 and 46′ are located on either side of insertion zone 44. Reciprocable insertion tooling is located within housings 46, 46′ and will be subsequently described in sufficient detail. A cantilever arm 48 extends through insertion zone 44 past insertion housing 46, 46′. Cantilever arm 48 has a carriage 50 which moves with respect to cantilever arm 48. This carriage operates in the same manner as that disclosed in U.S. Pat. No. 3,766,622 and in application Ser. No. 556,983 filed Mar. 10, 1975.

Figure 4:
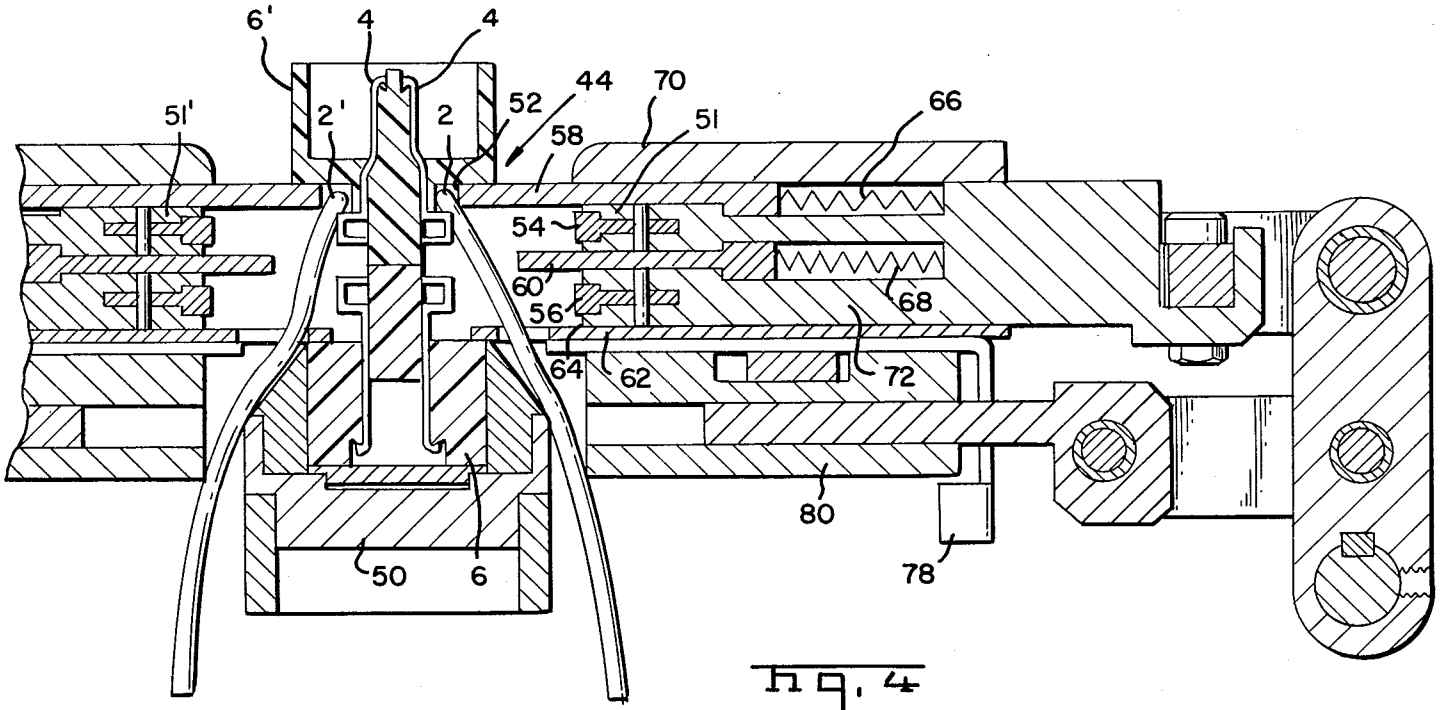
FIG. 4 is a sectional view showing an initial position of the insertion tooling.
Figure 5:
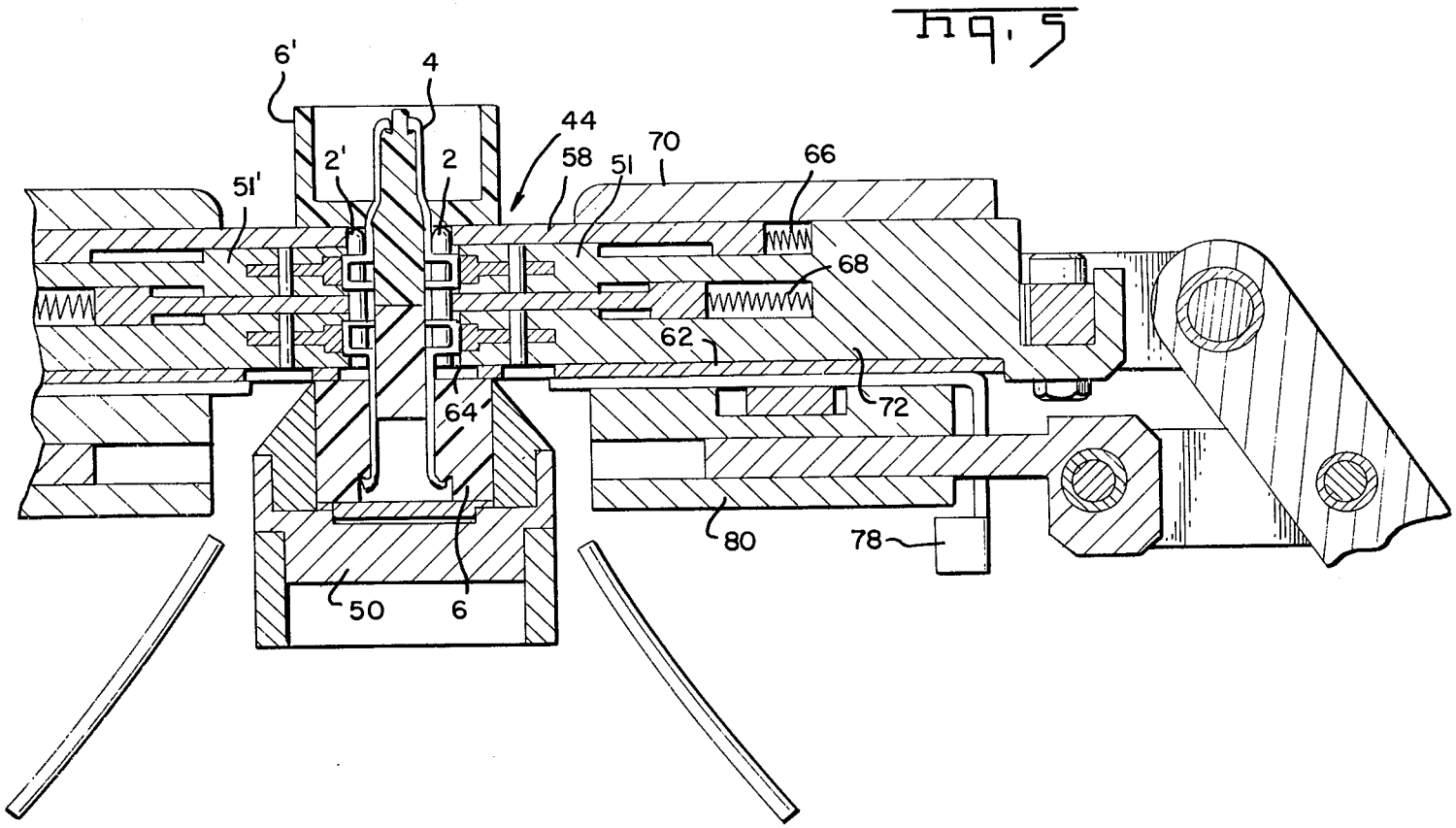
FIG. 5 is a similar sectional view showing the completion of the insertion and trimming operation.

FIG. 4 is a sectional view taken through insertion zone 44 showing reciprocal insertion tooling movable in housing 46 and 46′. The stroke length of the insertion rams in FIGS. 4 and 5 has been exaggerated so that the insertion tooling can be more clearly shown. Two connectors have been positioned with their rearward side adjacent as in FIG. 2. The lower connector 6′ is mounted on carriage 50 in the same manner as with a conventional tool. Carriage 50 is hidden in FIG. 3. Upper connector 6 is rigidly attached to the lower connector 6′. Note that the wire receiving portions 16 of corresponding terminals in each connector are located within insertion zone 44. The reciprocal insertion tooling is shown in alignment with these wire-receiving portions. Insertion rams 51 and 51′ are located on opposite sides of insertion zone 44. Since both rams were substantially identical, only ram 51 will be described in detail.

Figure 6:
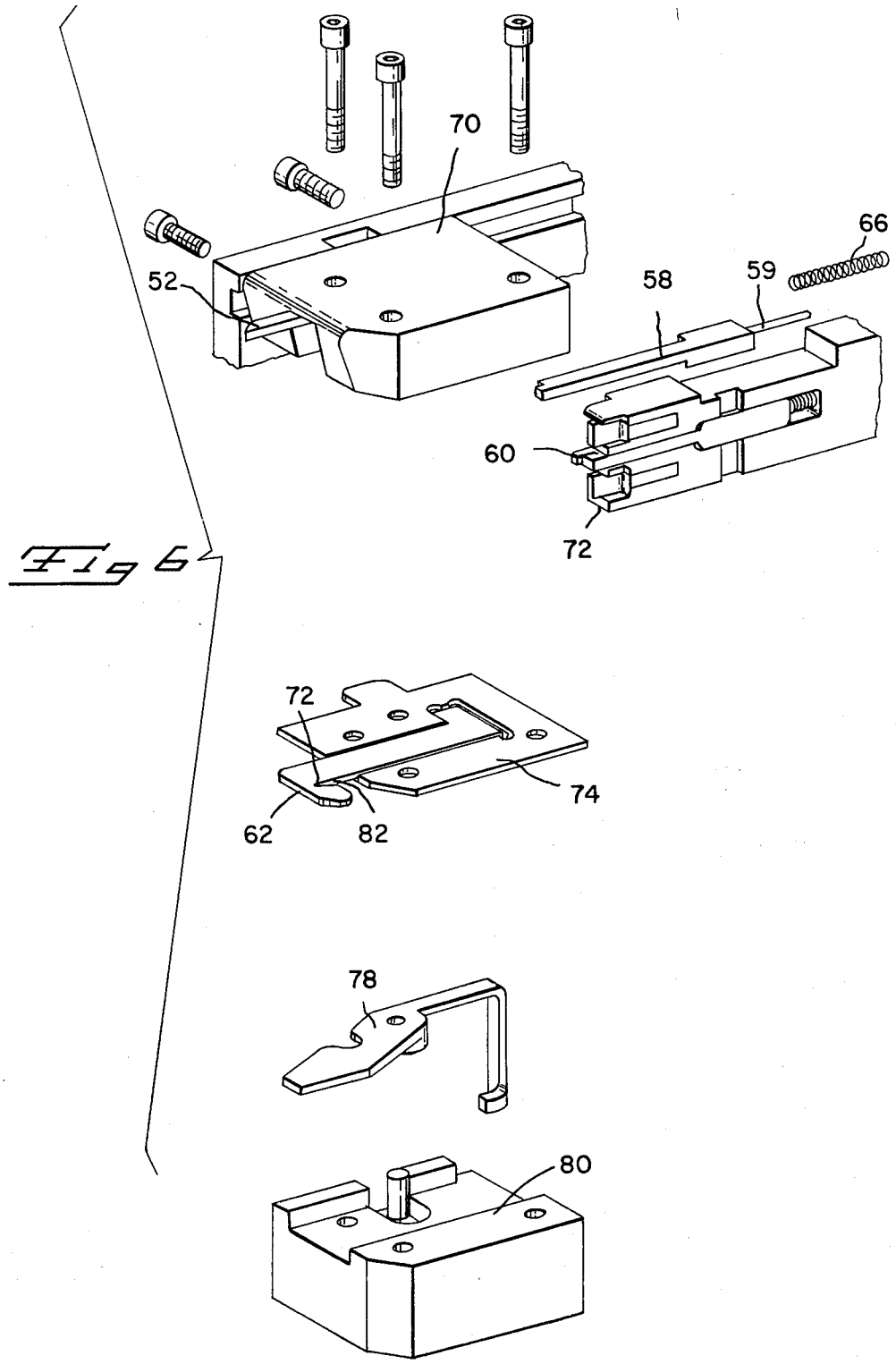
FIG. 6 is an exploded view showing one side of the insertion tooling.

An upper stationary block 70 is located immediately adjacent to the wire-receiving portions of upper connector 6. A stationary cantilever arm 52 extends from block 70 into insertion zone 44. This arm 52 is located immediately above the wire receiving portions of terminals in upper connector 6. Arm 52 serves as a stationary wire stop. Insertion ram 51 moves immediately below block 70 towards and away from insertion zone 44. The leading edge of insertion ram 51 contains upper and lower primary inserters or stuffers 54 and 56. Inserters 54 and 56 are rigidly mounted on insertion ram 51. Each inserter comprises a narrow rectangular blade having a width less than the width of the slot through the bight of terminal 4 at 15. Inserters 54 and 56 are shown in alignment with wire receiving portions of terminals in the upper and lower connectors. Inserters 54 and 56 being rigidly attached to ram 51 move with the ram during its reciprocable travel. An elongated finger 58 is located along the top of ram 51 at its leading edge. This elongated finger is in alignment with inserters 54 and 56 and is located immediately above upper primary inserter 54 at its leading edge. When insertion ram 51 is located in its retracted position as shown at in FIG. 4, finger 58 extends beyond primary inserters 54 and 56. Note that finger 58 is spring loaded with respect to ram 51. Spring 66 biases finger 58 to the left as shown in FIG. 4. A second elongated finger 60 is located between primary inserters 54 and 56. This finger is also spring loaded with respect to ram 51 and is likewise biases to the left past inserters 54 and 56. The leading edge of finger 58 is not necessarily aligned with the leading edge of finger 60. A plate like member 62 is located along the lower surface of insertion ram 51. Member 62 is generally fixed and does not move with ram 51. Plate like member 62 is adjacent to the lower connector 6 immediately below the adjacent wire-receiving portion. Plate like member 62 is shown in FIG. 6. Member 62 is roughly L-shaped and has a notch 82 located in its leading edge. Notch 82 is in alignment with inserters 54 and 56. The inner end of notch 82 faces ram 51. Plate-like member 62 lies against the lower surface 51. When ram 51 is in the retracted position of FIG. 4, notch 82 extends beyond the leading edge of ram 51. The remaining elements of this tool are essentially identical to the corresponding elements contained in the parent inventions.

OPERATION

When used to form the tap connector assembly depicted in FIG. 2, semi-automatic tool 42 operates in essentially the following manner. Connectors 6 and 6' are rigidly attached to each other. The lower connector 6' is mounted on carriage 50. Initially the terminals on the rear end of connector 6 and 6' are positioned in insertion zone 44. A cable 3 is secured to the top of tool 42 in the vicinity of the rear end of connectors 6 and 6'. Individual wires 2 and 2' are selected. These wires are then dressed across arm 52 which serves as a stationary wire stop. Wires 2 and 2' are brought down into insertion zone 44 on either side of connectors 6 and 6'. Each wire is then located between one insertion ram and the appropriate wire receiving portion of corresponding terminals. The operator holds the wires 2 and 2' below insertion zone 44. He then brings the wires into contact with a switch actuating lever 78 in the manner described in the parent application. Insertion rams 51 and 51' are then actuated and moved towards each other into insertion zone 44. Elongated members 58 and 60, which extend beyond the leading edge of ram 51, initially move with ram 51. Members 58 and 60 comprise upper and middle pre-inserters. The leading edge of these pre-inserters comes into contact with the appropriate wire and guides this wire partially into the slots in terminals 4. These pre-inserters insure that each wire is properly guided into the appropriate slot. Once wires 2 and 2' enter the slots, they exert a force which halts any further movement of pre-inserters 58 and 60. Springs 66 and 68 are then deflected by continued movement of ram 51. Upper and lower primary inserters 54', 56 then come into contact with the appropriate wire and drive that wire completely into the terminal slot. With the wires positioned in this manner, each wire is located within notch 82 of plate 62.

Plate 62 serves as a stationary shearing edge. The lower edge 64 of insertion ram 51 moves past notch 82 and severs each wire at this point. Wires are simultaneously trimmed and inserted into the wire-receiving portions of terminals in two connectors. Movable carriage 50 is now indexed to the next terminal location and a subsequent pair of wires are similarly inserted into the adjacent terminals.

I claim:

1. an electrical tap connection for a multi-conductor cable, said tap connection comprising:

first and second multi-contact electrical connectors, said connectors each having a mating side and a rearward side, a plurality of parallel terminal receiving cavities extending from said mating side to said rearward side in each of said connectors, contact terminals located in said terminal receiving cavities, each of said terminals having a contact portion located on said mating side and a wire-receiving portion located on said rearward side, said first and second connectors being positioned with corresponding terminals being in precise axial alignment, a plurality of individual wires comprising said cable, said wires extending from one end of said first connector generally perpendicular to said parallel rows of terminal receiving cavities and terminals therein, said wires extending generally between said wire-receiving portion and said contact portions of said terminals in said first connector, a right angle bend in one of said wires adjacent to each of said terminals in said first connector, each of said wires being attached intermediate their ends to said wire-receiving portions in said first connector and being attached relatively nearer their ends to wire-receiving portions of corresponding terminals in said second connector, whereby a tap connection for said multi-conductor cable can be formed utilizing two separate multi-contact connectors and in which said wires comprising said cable comprise the interconnection of said connectors.

2. An electrical tap connection as set forth in claim 1 wherein said wire-receiving portions of said terminals in said first connector are proximate to said wire-receiving portions of said terminals in said second connector.

3. An electrical tap connection as set forth in claim 2 wherein the portions of said wires extending between wire-receiving portions in said first and second connectors are parallel to the axis of said terminals.

4. An electrical tap connection as set forth in claim 1 wherein said wire-receiving portions comprise means for establishing contact with an insulated wire by moving said insulated wire laterally of its axis into said wire-receiving portion.

5. An electrical tap connection as set forth in claim 4 where said connectors each have two parallel rows of terminals with said wire-receiving portions being oppositely directed so that a fraction of said wires in said cable are attached to terminals in one row and the remainder of said wires are attached to terminals in the other row.

6. A multi-conductor tap connection comprising a multi-conductor cable incorporating individual wires and first and second multi-contact electrical connectors; each said connector having a mating side and a rearward side with at least one row of contact terminals, said rows extending from a first to a second end of said connectors, each said terminal extending from said rearward side to said mating side in one of said connectors, each said terminal having a wire receiving portion adjacent said rearward side; said tap connection being fabricated by the process of:

positioning said two connectors in reverse orientation with said rearward sides proximate, and with corresponding terminals in each of said connectors in alignment, with said rows of terminals being parallel, positioning said cable adjacent said first end of said first and second connectors, generally parallel to said rows and transverse to said terminals, lacing said wires generally between the wire receiving portions of said terminals in said first connector and said mating side of said first connectors, deflecting each wire generally through a right angle in the vicinity of one terminal so that the end portion of each wire extends parallel to said one terminal in said first connector and parallel to the corresponding terminal in said second connector, with the end portion of each said wire being in alignment with the wire receiving portions of corresponding terminals, and inserting each said wire into said wire receiving portions of said corresponding terminals.

7. A multi-conductor tap connector fabricate by the process of claim 6 wherein said wires are sequentially inserted into wire receiving portions of corresponding pairs of said terminals.

8. A multi-conductor tap connector fabricated by the process of claim 7 wherein sequential insertion of said wires begins at said first end and proceeds in order to said second end of said connectors.

9. A multi-conductor tap connector fabricated by the process of claim 6 wherein said wires are cut adjacent to said wire receiving portion of said terminals in said second connector.

10. A multi-conductor tap connector fabricated by the process of claim 9 wherein said wires are cut essentially simultaneously with said insertion of said wires into said wire receiving portions.

* * * * *